US006272306B1

(12) United States Patent
Saito et al.

(10) Patent No.: US 6,272,306 B1
(45) Date of Patent: Aug. 7, 2001

(54) DEVELOPING APPARATUS AND IMAGE FORMING APPARATUS HAVING FIRST AND SECOND VOLTAGES APPLIED TO A DEVELOPING SATISFYING PREDETERMINED RELATIONSHIPS

(75) Inventors: Masanobu Saito, Kashiwa; Keiji Okano, Tokyo; Gaku Konishi, Kashiwa; Yasushi Shimizu, Toride; Hiroshi Satoh, Moriya-machi; Akira Domon, Kashiwa; Satoru Motohashi, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/416,947

(22) Filed: Oct. 13, 1999

(30) Foreign Application Priority Data

Oct. 16, 1998 (JP) ..... 10-314012

(51) Int. Cl.[7] ..... G03G 15/09
(52) U.S. Cl. ..... 399/270; 399/285
(58) Field of Search ..... 399/222, 252, 399/258, 270, 285

(56) References Cited

U.S. PATENT DOCUMENTS

| | | | | |
|---|---|---|---|---|
| 5,202,731 | * | 4/1993 | Tanikawa et al. | 399/270 |
| 5,212,524 | * | 5/1993 | Tanikawa et al. | 399/258 |
| 5,235,386 | * | 8/1993 | Yano et al. | 399/222 X |
| 5,618,647 | | 4/1997 | Kukimoto et al. | 430/106.6 |
| 5,923,917 | | 7/1999 | Sakurai et al. | 399/27 |
| 6,009,299 | * | 12/1999 | Ishihara et al. | 399/252 X |

FOREIGN PATENT DOCUMENTS

| | | |
|---|---|---|
| 1-253776 | 10/1989 | (JP) . |
| 4-009865 | 1/1992 | (JP) . |
| 7-248645 | 9/1995 | (JP) . |
| 8-297413 | 11/1996 | (JP) . |
| 8-305141 | 11/1996 | (JP) . |

* cited by examiner

*Primary Examiner*—Fred L' Braun
(74) *Attorney, Agent, or Firm*—Fitzpatrick, Cella, Harper & Scinto

(57) ABSTRACT

A developing apparatus includes a developer bearing member for bearing and carrying developer to a developing area. A developer is borne on the developer bearing member, wherein the developer has a weight average particle size not exceeding 6.5 $\mu$m and contains an external additive of a charging polarity opposite to that of the developer. A voltage application device applies a voltage to the developer bearing member, wherein the voltage including at least a first voltage V1 for acting on the developer in a direction from the developer bearing member toward an image bearing member and a second voltage V2 for acting on the developer in a direction from an image bearing member toward said developer bearing member, and a charged potential VL of the image bearing member, a latent image potential VD a distance H between the developer bearing member and an image bearing member, and wherein the voltages V1 and V2 satisfy a following relationships:

$$|V1-VL|/H \leqq 3.7\times10^{-6}\ \text{V/m; and}$$

$$|V2-VD|/H \leqq 2.9\times10^{-6}\ \text{V/m.}$$

7 Claims, 16 Drawing Sheets

DUTY BIAS

CONVENTIONAL BIAS

DUTY BIAS

CONVENTIONAL BIAS

DEVELOPING APPARATUS AND IMAGE FORMING APPARATUS HAVING FIRST AND SECOND VOLTAGES APPLIED TO A DEVELOPING SATISFYING PREDETERMINED RELATIONSHIPS

BACKGROUND OF THE INVENTION

1. Field of the Invention

The present invention relates to an image forming apparatus such as an electrophotographic copying apparatus or an electrophotographic printer, and more particularly to a developing apparatus therefor and an image forming apparatus utilizing such developing apparatus.

2. Related Background Art

In the image forming apparatus of electrophotographic system such as a laser beam printer or a copying machine, the developing apparatus therefor employs powdered developer, namely toner. The toner is contained in a developing container, carried by developer carrying means onto a developer bearing member and borne on a developer bearing member. The developer layer is subjected to thickness regulation and is given a predetermined electric charge by a regulating member, and is then carried to a developing area where the developer bearing member and an image bearing member are mutually opposed, thus being used in the development of the electrostatic latent image formed on the image bearing member.

FIG. 14 shows a magnetic one-component developing apparatus as an example of the developing apparatuses. This developing apparatus is provided with a developing container 43 containing magnetic toner (not shown) constituting magnetic one-component developer, and the magnetic toner is negative insulating toner having an average particle size of 6.6 to 9.0 μm. At the aperture of the developing container 43, a developing sleeve 40 constituting the developer bearing member and consisting of an aluminum pipe is rotatably provided with a gap of about 300 μm to a photosensitive drum 1. The developing apparatus of this example is constructed to be compact, and the developing sleeve 40 is accordingly designed with a diameter of 12 mm. The surface of the developing sleeve 40 is finished with suitable roughness, in order to bear and carry the toner of a desired amount thereon.

Inside the developing sleeve 40, there is provided an inrotational magnet roller 42 of a diameter of 10 mm, having two sets of magnetic poles N, S in alternate manner. Above the developing sleeve 40, there is provided an elastic blade 41 for example, of urethane rubber, constituting a developer regulating member, which abuts against the developing sleeve 40 with an abutting (contact) pressure of about 8 gf/cm. Behind the developing container 43, there is provided a developer carrying member 15.

The contact pressure of the elastic blade 41 is represented by so-called extracting pressure. In the present specification, the contact pressure of the elastic blade is always represented by the extracting pressure, which is measured as shown in FIG. 15.

As shown in FIG. 15, a stainless steel thin plate 45*a* of a thickness of 25 μm is folded and another stainless steel thin plate 45*b* of a same thickness is sandwiched therebetween. These plates are inserted between the developing sleeve 40 and the elastic blade 41 in contact therewith and the stainless steel thin plate 45*b* in the center is extracted by an unrepresented spring scale. The extracting pressure is determined by dividing the reading of the spring scale, when the stainless steel thin plate 45*b* in the center is extracted, with the width thereof namely the length across the extracting direction.

The magnetic toner contained in the developing container 43 is carried onto the developing sleeve 40 by the carrying member 15 and is supported on the surface of the developing sleeve 40 by the magnetic force of the magnetic roller 42. The toner thus supported is carried by the rotation of the developing sleeve 40 to the position of the elastic blade 41, where the thickness of the toner layer is regulated to an appropriate value by the elastic blade 41 maintained in contact with the developing sleeve 40 and an appropriate triboelectric charge (triboelectricity) is given by the friction between the developing sleeve 40 and the elastic blade 41.

The magnetic toner, thus adjusted in layer thickness and given the triboelectricity, is carried by the rotation of the developing sleeve 40 to the developing area opposed to the photosensitive drum 1, and is used for developing the electrostatic latent image formed thereon.

At the development, a developing bias voltage, consisting of superposed AC and DC voltages, is applied to the developing sleeve 40 by a high voltage source 44, and the toner on the developing sleeve 40 is deposited onto the latent image on the photosensitive drum 1, thereby developing the latent image, while repeating the reciprocating motion between the developing sleeve 40 and the photosensitive drum 1 as if continuing the jumping motions according to the potential change in the AC component of the developing bias. Thus the latent image is visualized as a toner image by developing.

The toner particles are recently made finer in order to achieve faithful image reproduction of the electrostatic latent image thereby improving the image quality, but it is found that the fine particle toner with the weight average particle size D4 of 6.5 μm or smaller tends to result in a low image density when applied to the compact developing apparatus shown in FIG. 14, because such small sized toner is difficult to charge.

FIG. 16 shows the difference in the variation of the image density as a function of the number of copies, between the toner of a particle size of 6 μm and that of 8 μm.

The average particle size of the toner can be measured with various methods, but it is measured in the present specification with the Coulter Multisizer II (Coulter Electronics, Inc.), employing the following method.

Aqueous NaCl solution of about 1% is prepared as electrolyte, employing primary sodium chloride. (Also ISOTRON (R)-II is available as the commercial product from Coulter Scientific Japan Co.) 150 to 200 ml of the electrolyte is added with a surfactant, preferably 0.1 to 5 ml of alkylbenzene sulfonate salt, as the dispersant, and with 2 to 20 mg of the toner as the specimen to be measured. Then the electrolyte in which the specimen is dispersed is subjected to dispersion for 1 to 3 minutes by an ultrasonic disperser and to the measurement of the volume and number of the toner particles with the above-mentioned measuring apparatus with an aperture of 100 μm, and the volume distribution and the number distribution are calculated. Then the weight average particle size D4 is calculated from the volume distribution (central value of each channel being taken as the representative value therefor).

Referring to FIG. 16, the toner of the average particle size of 8 μm provides a generally high image density even to the latter phase of 2500 image formations, though the image density is somewhat lower in the initial phase of the image formations. On the other hand, the toner of the average particle size of 6 μm provides a particularly low image density in the initial phase of image formations and a generally low image density even to the latter phase of the image formations.

As will be apparent from these results, the image density tends to become low and has to be improved in case the fine particle toner of an average particle size of 6.5 μm or less is used in the compact developing apparatus.

In the developing apparatus shown in FIG. 14, an increase of the contact pressure (extracting pressure) of the elastic blade 41 to the developing sleeve 40 from 8 gf/cm to about 30 gf/cm improved the triboelectric charging ability of the elastic blade 41 on the fine particle toner, thereby giving a larger charge thereto and improving the low image density.

FIG. 17 shows the change in the initial density of the solid black image as a function of the contact pressure of the elastic blade. In order to obtain a satisfactory density in the solid black image even from the initial phase of image formation, it is necessary, as shown in FIG. 17, to maintain the contact pressure of the elastic blade 41 at 20 gf/cm or higher.

However, such high contact pressure of the elastic blade 41 causes the developing sleeve 40 of a small diameter and a small thickness to bend, whereby the developing sleeve 40 is positioned close, at the central portion in the longitudinal direction, to the magnet roller 42 positioned therein and comes eventually in contact therewith.

In the presence of contact with the magnet roller 42, the developing roller 40 slides frictionally on the magnet roller 42 in the course of rotation, thereby causing drawbacks such as noise generation and an increased rotation torque of the developing sleeve 40.

Thus, in order to prevent the low image density in the development with the fine particle toner of the average particle size of 6.5 μm or less, the developing sleeve 40 has to be given a larger strength, for example, by increasing the diameter to about 16 mm and increasing the thickness, in order to withstand the high contact pressure of the elastic blade 41.

In such case, however, the developing apparatus inevitably becomes larger in dimension. Also it is difficult to satisfactorily achieve compactization, which is strongly requested in the process cartridge.

SUMMARY OF THE INVENTION

An object of the present invention is to provide a developing apparatus capable of preventing low image density in the image development with the fine particle toner, and an image forming apparatus utilizing such developing apparatus.

Another object of the present invention is to provide a developing apparatus capable of preventing low image density with the fine particle toner without increasing the contact pressure of the elastic blade, thereby enabling compactization for example by reducing the diameter of the developing sleeve, and an image forming apparatus utilizing such developing apparatus.

Still another object of the present invention is to provide a developing apparatus comprising:

a developer bearing member for bearing and carrying developer to a developing area; and developer borne on the developer bearing member, wherein the developer has a weight average particle size not exceeding 6.5 μm and contains an external additive of a charging polarity opposite to that of the developer.

There is also provided an image forming apparatus comprising:

an image bearing member for bearing a latent image;

a developer bearing member for bearing and carrying a developer to a developing area; and developer borne on the developer bearing member, wherein the developer has a weight average particle size not exceeding 6.5 μm and contains an external additive of a charging polarity opposite to that of the developer.

Still other objects of the present invention, and the features thereof, will become fully apparent from the following detailed description which is to be taken in conjunction with the attached drawings.

DESCRIPTION OF THE PREFERRED EMBODIMENTS

Now the present invention will be clarified in more details by preferred embodiments thereof, with reference to the attached drawings.

Figure 1:
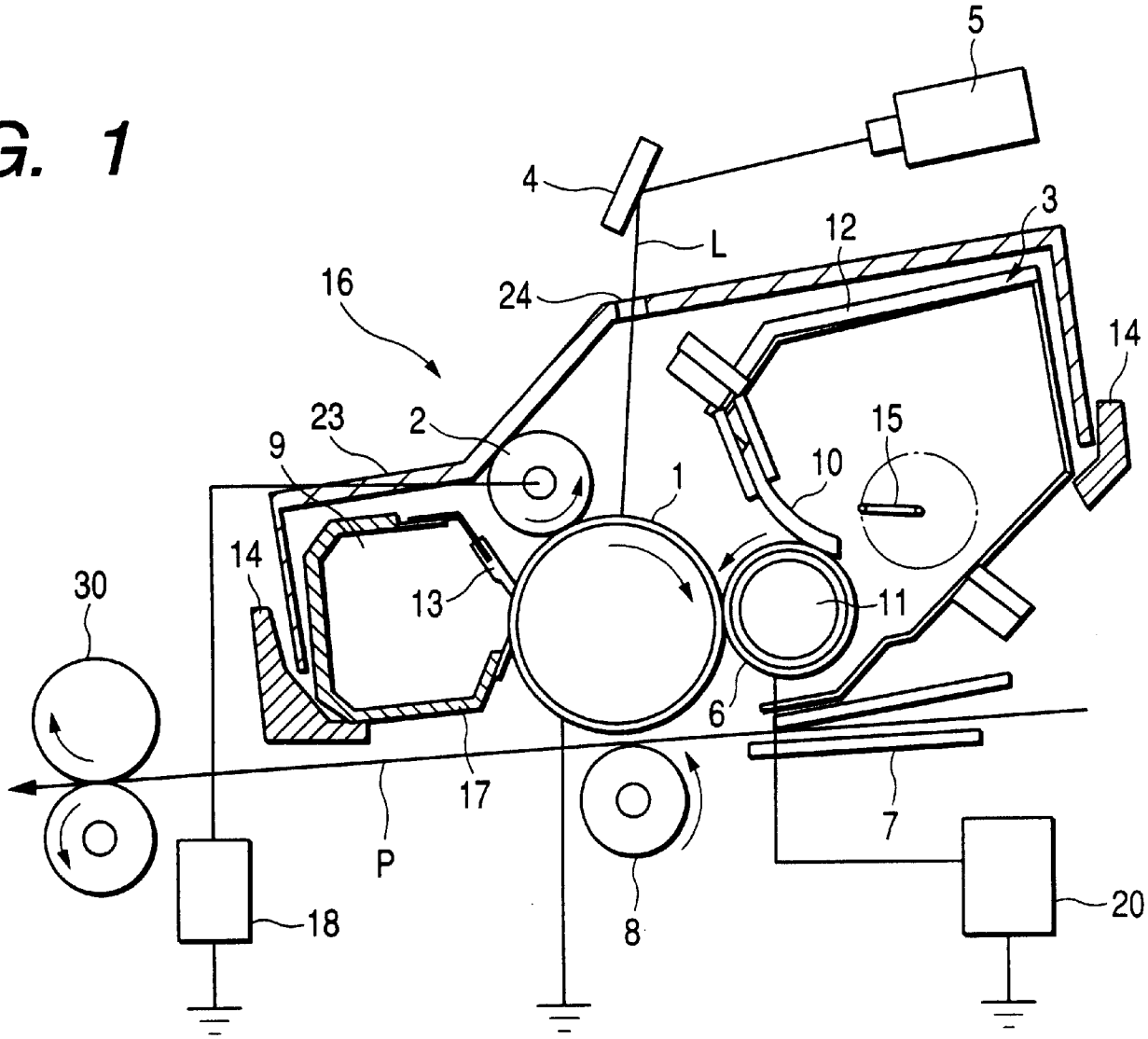
FIG. 1 is a schematic cross-sectional view showing the configuration of an embodiment of the image forming apparatus of the present invention.

FIG. 1 is a schematic view showing the configuration of an embodiment of the image forming apparatus of the present invention, which is constructed as a laser beam printer utilizing the electrophotographic process and employing a process cartridge.

As shown in FIG. 1, the printer is provided with a process cartridge 16 which is detachably attachable to the main body of the printer, and the process cartridge 16 is composed of four process devices, namely a photosensitive drum 1, a charging roller 2, a developing apparatus 3 and a cleaning device 9, assembled in a cartridge frame 23. The process cartridge 16 is detachably attached in the main body of the printer and is positioned therein, by being received by support members 14 provided in plural positions in the main body of the apparatus.

In the present invention, the process cartridge may be composed of a combination of the photosensitive drum 1 and at least one of the charging roller 2, the developing apparatus 3 and the cleaning device 9.

On the upper face of the frame 23 of the process cartridge 16, there is provided a slit aperture portion 24 through which a laser beam L enters. Also the lower face of the frame 23 is formed as an aperture, in which provided is an unrepresented shutter for covering the lower face exposed portion of the photosensitive drum 1. The shutter is closed to cover the lower face of the photosensitive drum 1 when the process cartridge 16 is taken out from the main body of the printer, but is opened to expose the lower face of the photosensitive drum 1 when the process cartridge 16 is mounted in the main body.

The process cartridge 16, when mounted in the main body of the printer, is mechanically and electrically coupled therewith in such a manner that the photosensitive drum 1 and the developing sleeve 6 of the developing apparatus 3 can be driven by a driving mechanism in the main body of the printer and the charging roller 2 and the developing sleeve 6 can be supplied with predetermined bias voltages from a power source in the main body of the printer.

The photosensitive drum 1, constituting an electrophotographic photosensitive member of the shape of a rotary drum, is composed in the present embodiment by forming a photosensitive layer consisting of an organic photoconductive layer (OPC) on a cylindrical aluminum substrate, which is electrically grounded. The photosensitive drum 1 is rotated clockwise at a predetermined peripheral speed (process speed), for example 50 mm/sec.

In the course of rotation of the photosensitive drum 1, the surface thereof is uniformly charged at a predetermined potential VD (dark potential) of a predetermined polarity, by the charging roller 2. The charging roller 2 is rotated by the contact with the surface of the photosensitive drum 1 and receives the application of a vibrating voltage, consisting of superposed AC and DC voltages from the high voltage source 18, thereby charging the surface of the photosensitive drum 1. In the present embodiment, the surface of the photosensitive drum 1 is charged at a dark potential (potential of dark portion) VD of −600 V.

The charged photosensitive drum 1 is exposed to the laser beam L emitted from a laser scanner 5 and modulated according to a time-sequential electrical digital image signal representing the image information. The laser beam L scans the surface of the photosensitive drum 1 through a mirror 4, thereby forming an electrostatic latent image corresponding to the desired image information and composed of a background dark potential VD and a light potential VL, on the surface of the photosensitive drum 1. In the present embodiment, the light potential (potential of light portion) VL constituting the electrostatic latent image is 150 V.

The electrostatic latent image formed on the photosensitive drum 1 is reversal developed with toner charged negatively in the developing apparatus 3, thereby visualized as a toner image. At the developing operation, the developing sleeve 6 of the developing apparatus 3 is given a predetermined developing bias from a high voltage source 20. The developing apparatus 3 will be explained later in more details.

Separately, recording material P, conveyed from an unrepresented sheet feeding unit through a transfer guide 7, is supplied to a contact nip portion (transfer area) between the photosensitive drum 1 and a transfer roller 8 maintained in contact therewith, in synchronization with the toner image formation on the photosensitive drum 1. The toner image on the photosensitive drum 1 is transferred onto the recording material P by means of the transfer roller 8, under the application of a predetermined transfer bias from an unrepresented high voltage source.

The recording material P, bearing the transferred toner image, is guided from the transfer area to a fixing device 30, in which the toner image is fixed to the surface of the recording material P under the application of heat and pressure, and is then discharged as an image formed matter (print) from the printer.

Figure 2:
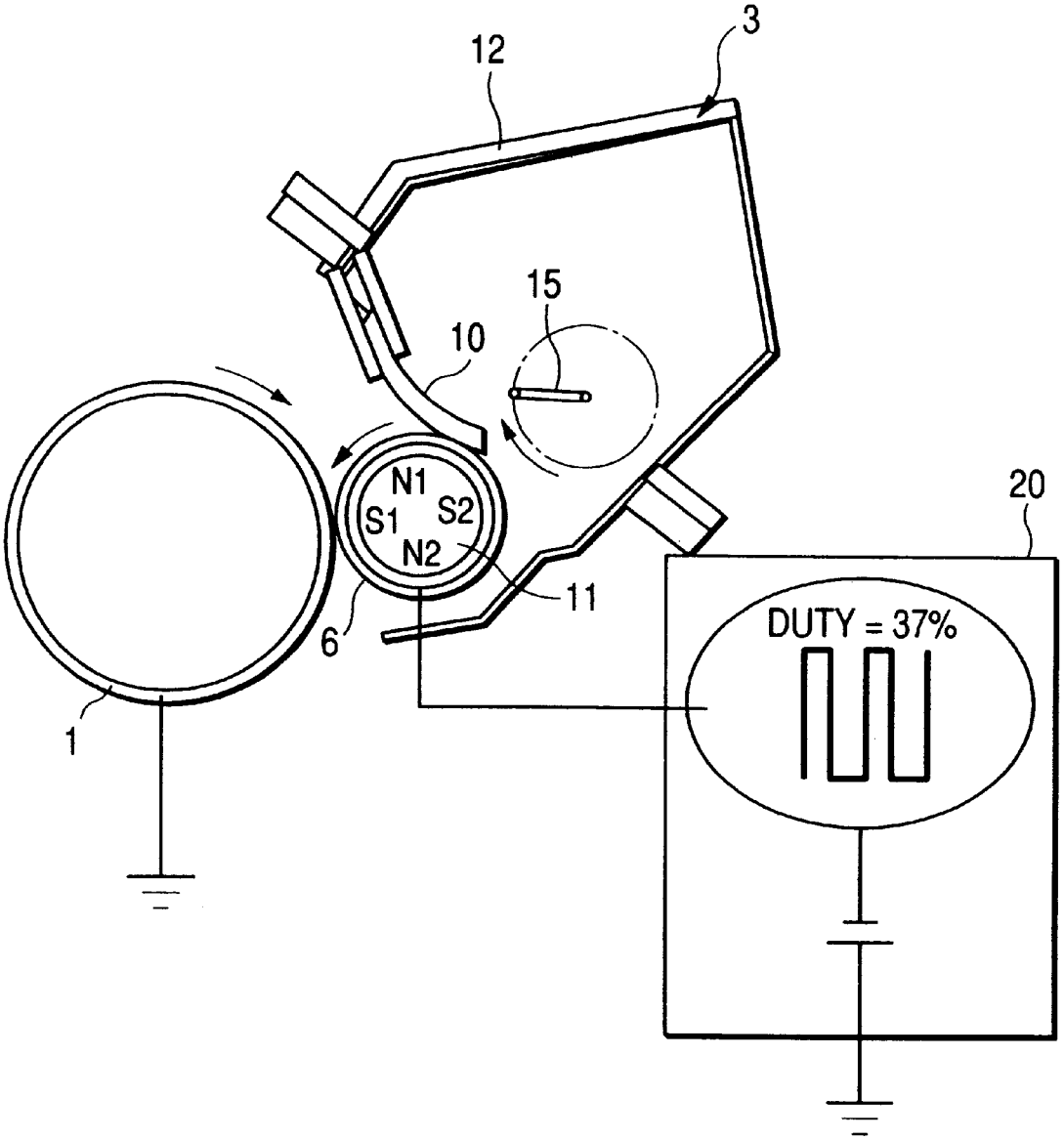
FIG. 2 is a cross-sectional view showing the part of the developing apparatus in the image forming apparatus shown in FIG. 1.

As shown in FIG. 2, the developing apparatus 3 is provided with a developing container 12 containing magnetic toner constituting magnetic one-component developer, and, in the aperture of the developing container 12, there is rotatably positioned the aforementioned developing sleeve 6 with a predetermined gap to the photosensitive drum 1. The developing sleeve 6 is constructed with a small diameter and a small thickness, and is composed of an aluminum pipe of a diameter of 12 mm and a thickness of 1 mm. The surface of the developing sleeve 6 is made coarse by forming a conductive resin layer. The conductive resin is obtained by mixing carbon particles and graphite as a solid lubricant with phenolic resin.

Inside the developing sleeve 6, there is non-rotatably provided a magnet roller 11 of a diameter of 10 mm, on which magnetic poles N1, S1, N2, S2 are formed in alternating manner. Above the developing sleeve 6 an elastic blade 10 is provided as a developer regulating member, and the elastic blade 10 is maintained in contact with the surface of the developing sleeve 40 with a predetermined contact pressure. In a deeper part of the developing container 12, there is provided a developer carrying member 15.

The magnetic toner is composed of negatively chargeable high-resistance insulating fine particle toner of an average particle size (weight average particle diameter D4) of 6 μm. Such fine particle toner is produced by mixing 100 parts by weight of binder resin, 100 parts by weight of a magnetic substance and 1 part by weight of a negative chargeable charge controlling agent, fusing and kneading the mixture, then crushing the mixture, classifying the crushed mixture to obtain powder with the weight average particle size D4 of 6 μm, and adding in dry state 1.5 parts by weight of fine hydrophobic silica powder and 0.6 parts by weight of strontium titanate as a positive external additive.

The magnetic toner contained in the developing container 12 is carried by the carrying member 15 to the developing sleeve 6, and is borne on the surface thereof by the magnetic force of the magnet roller 11. The borne toner is carried by the rotation of the developing sleeve 6 to the position of the elastic blade 10, then adjusted to an appropriate thickness by the elastic blade 10 maintained in contact with the developing sleeve 6, and is given an appropriate triboelectric charge by being rubbed between the developing sleeve 6 and the elastic blade 10.

The magnetic force of the magnet roller 11 is 75 mT at the magnetic pole S1 opposed to the photosensitive drum 1, 65 mT at the pole N1 in the vicinity of the elastic blade 10, 60 mT at the pole S2 directed toward the deeper portion of the developing container 12, and 65 mT at the pole N2 opposed to the lower part of the developing sleeve 6.

After the layer thickness regulation and the triboelectric charging, the toner is carried by the rotation of the developing sleeve 6 to the developing area and is used for developing the electrostatic latent image formed on the photosensitive drum 1. At the developing operation, the high voltage source 20 applies a developing bias voltage, consisting of superposed AC and DC voltages, to the developing sleeve 6. The developing bias will be explained later in more details.

As the fine particle toner, having the weight-averaged particle size D4 of 6.5 μm or less is difficult to charge by friction, the contact pressure of the elastic blade 10 has to be increased in order to obtain a sufficient triboelectric charge. However, in a compact developing apparatus, the developing sleeve 6, having a small diameter and a small thickness, tends to bend by the pressure applied by the elastic blade 10.

The present invention, therefore, is to supply the fine particle toner which is difficult to charge, with a sufficient charge even with a contact pressure of the elastic blade 10 not exceeding 20 gf/cm, thereby preventing the low density in the developed image. Such technology will be detailedly explained in the following.

In the present embodiment, the magnetic toner is composed of negatively chargeable fine particle toner with the average particle size (weight average particle diameter D4) of 6 μm, but such magnetic toner is subjected to the external addition, as explained in the foregoing, of strontium titanate as a positive external additive, in addition to the fine hydrophobic silica powder which is ordinarily employed. Such positive external additive functions as so-called microcarrier, present between the toner particles and providing electric charge. The positive external additive for the negatively chargeable toner can, for example, be particles of melanine resin, in addition to the aforementioned compound.

The elastic blade 10 is formed by adhering urethane rubber of a thickness of 0.9 mm to a supporting metal plate, and is maintained in contact, in the present embodiment, with the developing sleeve 6 with a contact pressure (extracting pressure) of 8 gf/cm which is lower than the conventional pressure of 30 g/cm.

Table 1 shows the toner coating amount M/S on the developing sleeve 6 and the average charge amount Q/M of the toner, when the fine particle toner including the positive external additive is regulated with the elastic blade 10 of the above-mentioned contact pressure of 8 gf/cm. Table 1 also shows, as comparative example 1, 2 and 3, the results when the fine particle toner without the positive external additive is regulated with the elastic blade 10 under contact pressures of 8, 20 and 30 gf/cm.

TABLE 1

| | Elastic blade contact pressure | Addition of positive external additive | Toner coat amount | Toner charge amt. Q/M |
|---|---|---|---|---|
| Present invention | 8 g/cm | added | 1.8 mg/cm$^2$ | −12 μC/g |
| Compar. Ex. 1 | 8 g/cm | none | 1.8 mg/cm$^2$ | −7 μC/g |
| Compar. Ex. 2 | 20 g/cm | none | 1.5 mg/cm$^2$ | −10 μC/g |
| Compar. Ex. 3 | 30 g/cm | none | 1.2 mg/cm$^2$ | −14 μC/g |

As shown in Table 1, the present invention employing the negative fine particle toner with the addition of the positive external additive provides the toner on the developing sleeve 6 after the regulation of the toner layer thickness with an average charge amount Q/M of −12 μC/g, substantially equal to that obtained with the contact pressure of 20 to 30 g/cm of the elastic blade 10 in the comparative examples 2 and 3.

Figure 3:
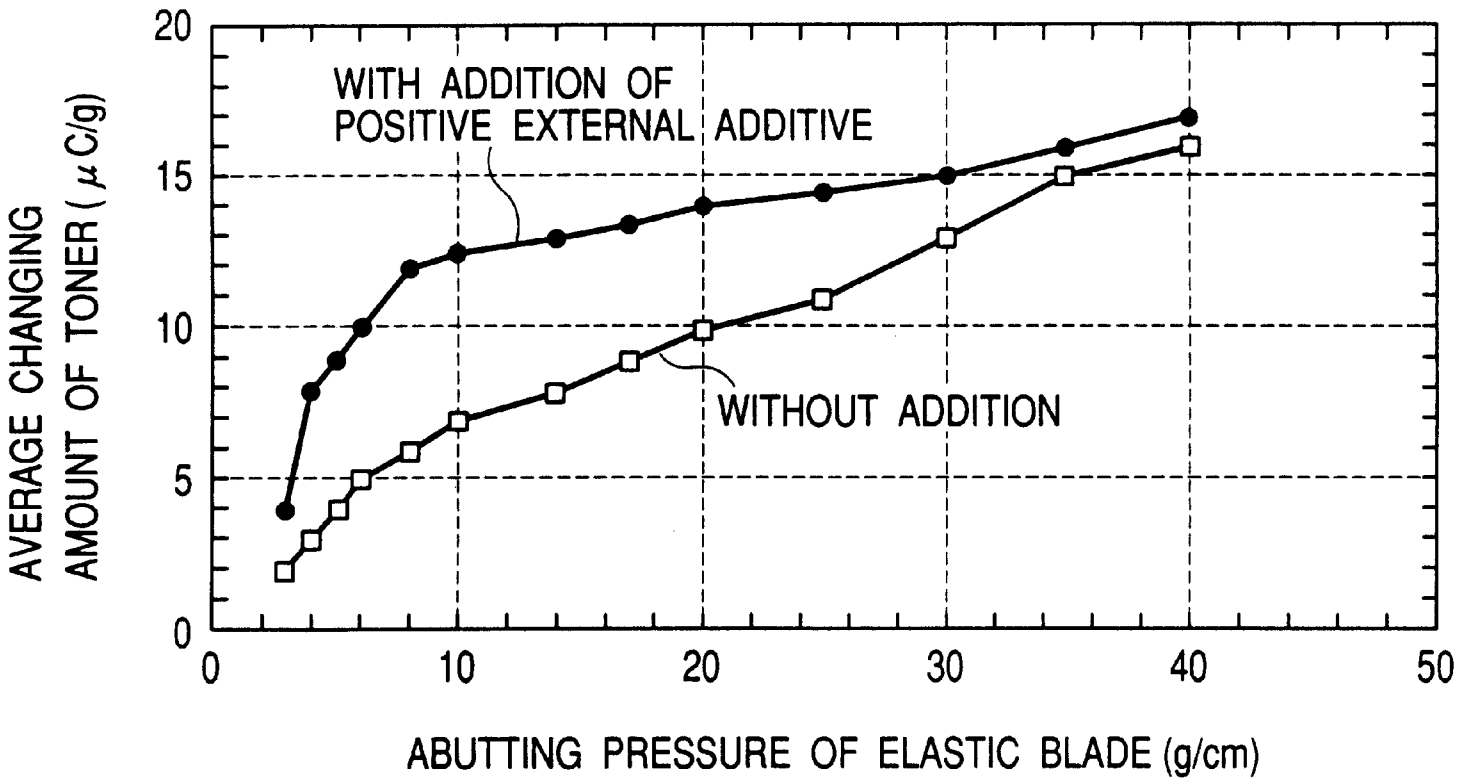
FIG. 3 is a chart representing the change in the average charge amount of negative fine particle toner as a function of the contact pressure of the elastic blade, provided in the developing apparatus shown in FIG. 2, and showing the difference between the presence and absence of addition of the positive external additive to the toner.
Figure 4:
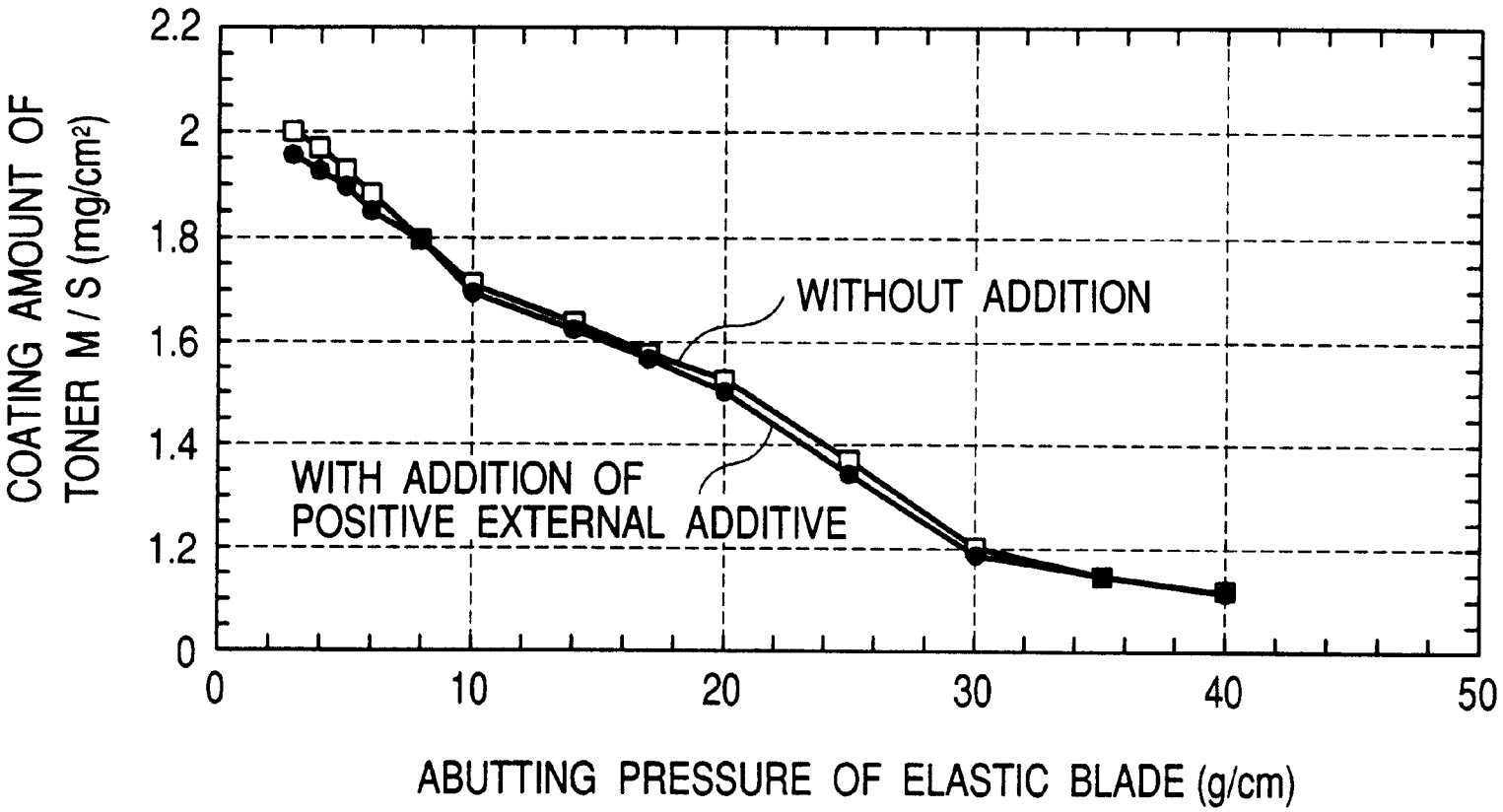
FIG. 4 is a chart representing the change in the coating amount of the negative fine particle toner as a function of the contact pressure of the elastic blade, and showing the difference between the presence and absence of addition of the positive external additive to the toner.

FIG. 3 shows the difference between the presence and absence of addition of the positive external additive in the change of the average charge amount Q/M of the negative fine particle toner as a function of the contact pressure of the elastic blade, and FIG. 4 shows the same difference in the change of the toner coating amount as a function of the contact pressure of the elastic blade. As shown in FIGS. 3 and 4, the toner coating amount on the developing sleeve 6 scarcely varies by the presence or absence of addition of the positive external additive to the negative fine particle toner, but the average charge amount of the toner considerably increases by the addition of the positive external additive.

The present invention, employing the addition of the external additive of a polarity opposite to that of the fine particle toner, allows to provide the toner with a sufficient average charge amount by regulation with the elastic blade of a low contact pressure.

In more detail, the toner charging in the conventional method is induced by the mutual friction between the toner particles, friction between the toner particles and the developing sleeve 6 and that between the toner particles and the elastic blade 10. However, the mutual friction between the toner particles scarcely contributes to the toner charging because the friction is made between the toner particles of a same polarity, though the opportunity of friction is very high due to the circulation of the major part of the toner in the developing container. Consequently the toner has to be charged principally by the friction with the developing sleeve 6 or the elastic blade 10, and can therefore be charged only insufficiently. In particular, the fine particle toner with the average particle size of 6.5 μm or less has a larger number of particles per unit weight in comparison with the toner of a larger average particle size, and the individual toner particle has less opportunity of contact with the developing sleeve 6 or the elastic blade 10 to result in a smaller charge amount.

In addition to the aforementioned triboelectric charging between the toner particles and the developing sleeve 6 or the elastic blade 10, the present invention provides a new charging opportunity by the friction between the negative toner and the positive external additive by the addition of the positive external additive to the negative fine particle toner. Such positive external additive is present between the particles of the negative fine particle toner and functions as so-called microcarrier, serving as spacer and roller and performing frictional contact with the toner particles to provide the toner particles with a charge. The toner containing such positive external additive exhibits sufficient triboelectric charging during the circulation in the developing container 12, thus acquiring the charge appropriate for the image development.

The function of the positive external additive as the microcarrier will be explained further with reference to FIGS. 5A and 5B.

Figure 5A:
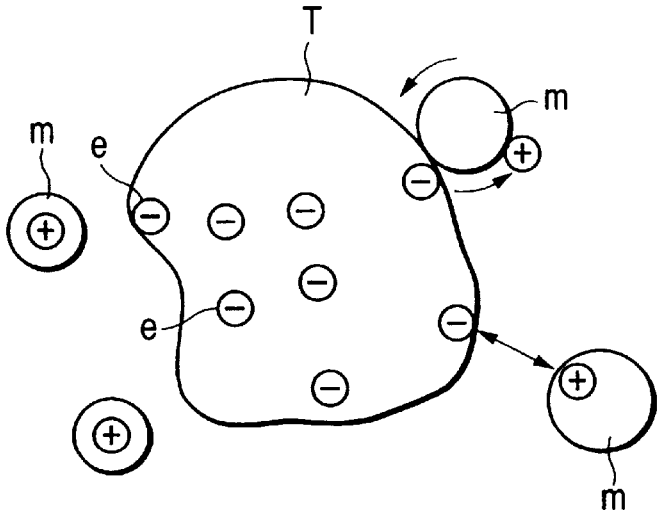
FIGS. 5A and 5B are schematic views showing the function, as microcarrier, of the positive external additive added to the negative toner in the present invention, respectively in the fine particle toner and in the conventional toner.

Referring to FIG. 5A, the negative fine particle toner T has an average particle size Rs=6 $\mu$m, while the positive external additive m has an average particle size Rp=1 $\mu$m, with a particle size ratio Rs:Rp=6:1, so that the positive external additive m is not so small as to be constantly adhered to the toner T. Therefore the external additive m repeats contact with and separation from the toner T, thereby exchanging charges with the toner T by the mechanical force in the course of circulation in the developing container 12.

More specifically, the positive external additive m rolls on the amorphous surface of the negative fine particle toner T as shown in FIG. 5A, thereby giving an electron e to the fine particle toner T and receiving a positive charge. When the positive external additive m is thereafter separated from the fine particle toner T, it becomes charged more negatively corresponding to the received electron e.

Figure 5B:
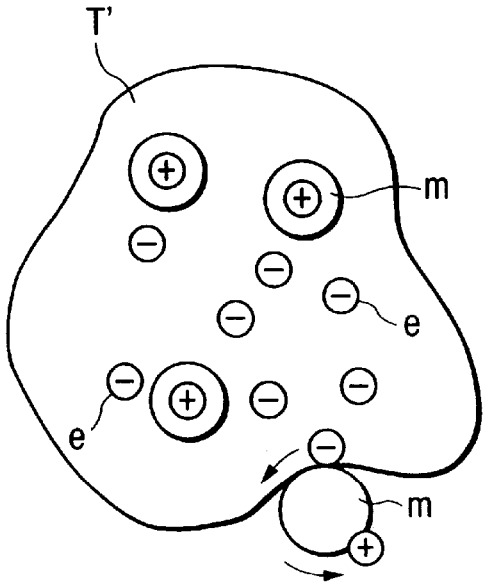

On the other hand, the conventional negative toner T' shown in FIG. 5B has an average particle size Rs=8 $\mu$m, with a particle size ratio Rs:Rp=8:1 to the positive external additive m (average particle size Rp=1 $\mu$m), so that the positive external additive m is considerably smaller than the conventional toner T' and tends to stick thereto. Therefore the external additive m is less easily shaken off from the toner particle T' by the mechanical force in the course of circulation in the developing container 12.

Thus, as shown in FIG. 5B, even if the toner T' is negatively charged by reception of the electron e from the external additive m in the course of contact and rolling thereof on the amorphous surface of the negative toner T', such negative charge is neutralized if the positively charged external additive m remains stuck to the toner T'. Consequently the positive external additive m cannot satisfactorily charge the toner T'.

Therefore the positive external additive m functions as the microcarrier more effectively on the fine particle toner than on the conventional toner, thereby causing the fine particle toner to acquire the charge appropriate for the image development.

Figure 6:
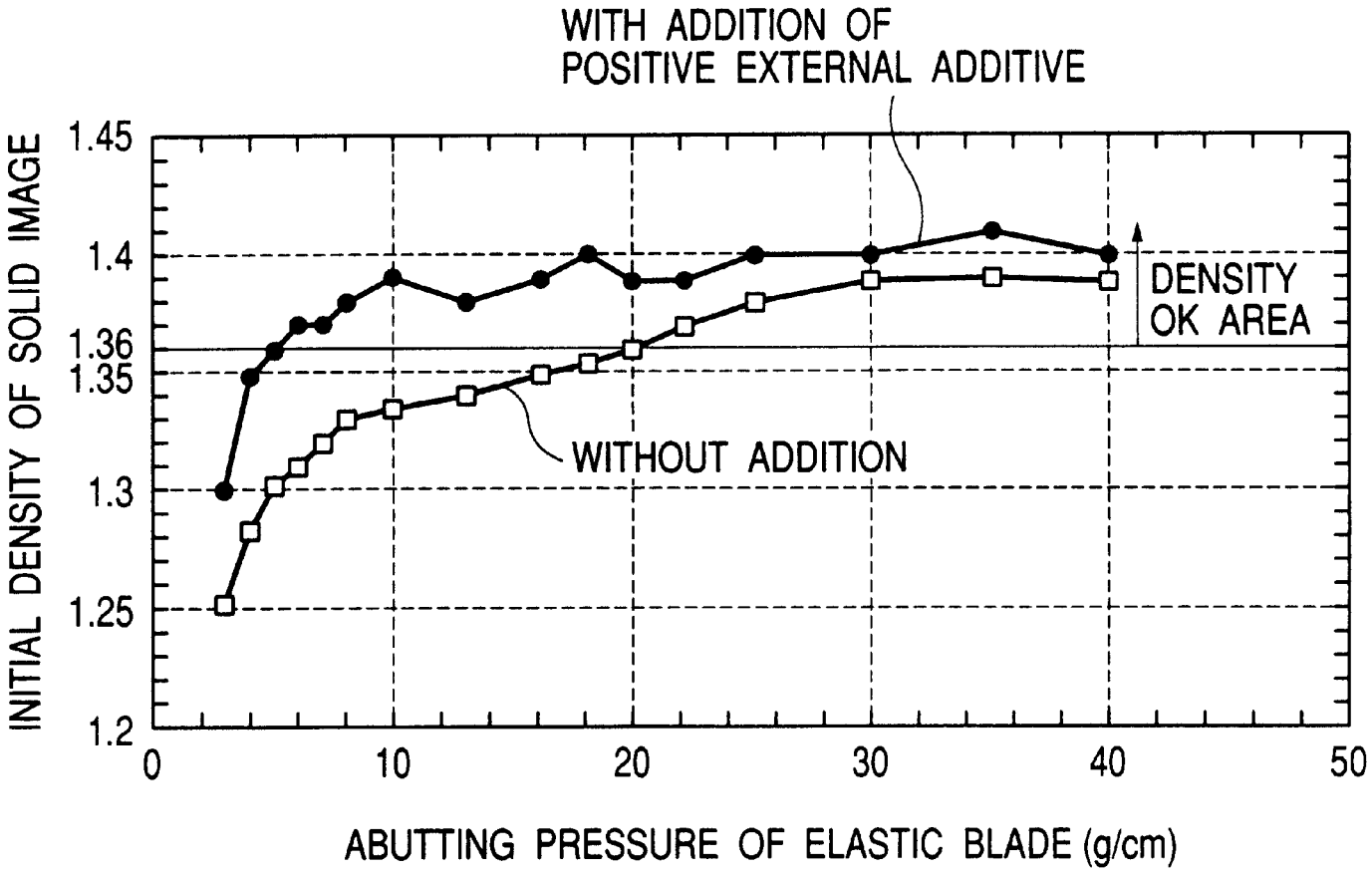
FIG. 6 is a chart representing the change in the initial density of the solid black image as a function of the contact pressure of the elastic blade and showing the difference between the presence and absence of addition of the positive external additive to the toner.

FIG. 6 is a chart showing the difference between the presence and absence of addition of the positive external additive to the negative fine particle toner, in the change of the initial density of the solid black image as a function of the contact pressure of the elastic blade. As shown in FIG. 6, the addition of the positive external additive to the fine particle toner provides an initial solid black density of 1.36 or higher even with a contact pressure of the elastic blade of 20 gf/cm or less, whereby a sufficient image density can be obtained even from the initial phase of image formations.

The positive external additive, being charged in a polarity opposite to that of the negative toner, tends to fly to the white image area (dark potential area) in the image, and tends to be consumed from the initial phase of image formations because the white image area is generally larger than the black image area. A countermeasure is therefore required for these phenomena. In order to prevent the flying of the positive external additive to the white image area and to reduce the consumption of the external additive, there can be reduced the developing bias, but such reduced developing bias will also lower the developing ability of the fine particle toner.

Therefore, in the present invention, the developing bias applied to the developing sleeve 6 is so modified as to suppress the consumption of the positive external additive by flying to the white image area and not to lower the developing ability of the fine particle toner.

Figure 7A:
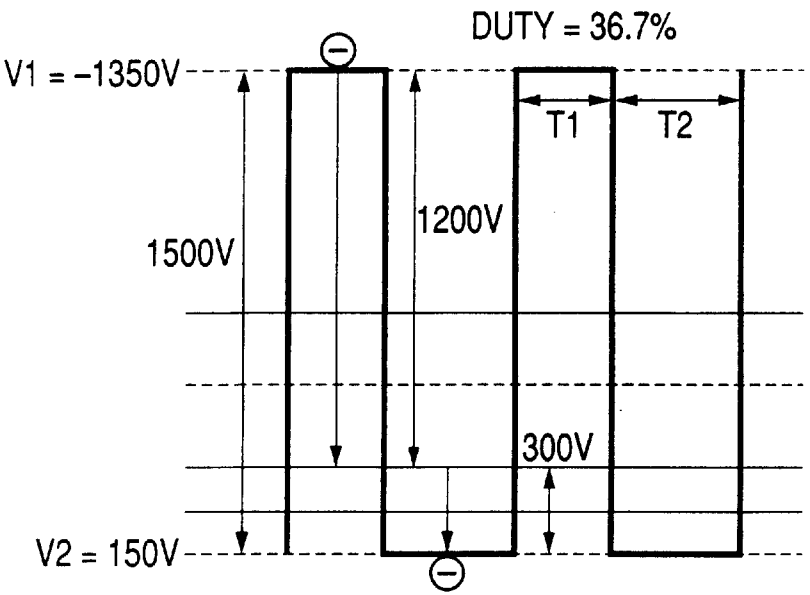
FIGS. 7A and 7B are potential charts respectively showing the wave form of the developing bias of the present invention and that of the conventional developing bias, with arrows indicating the direction of movement of the negative toner.

As explained in the foregoing, the developing sleeve 6 is maintained, by spacers provided at both ends, at a gap (SD gap) of 300 $\mu$m to the photosensitive drum 1. In the present invention, there is applied, between the developing sleeve 6 and the photosensitive drum 1, a developing bias voltage consisting of a rectangular AC bias voltage as shown in FIG. 7A. In the reversal development system, the electrostatic latent image is formed by the light potential portion VL, and the negatively charged toner flies to and is deposited on the light potential area VL under the application of the developing bias, thereby developing the latent image.

Referring to FIG. 7A, the rectangular AC bias has a peak-to-peak voltage Vpp=1500 V and a frequency f=1800 Hz, with a first peak voltage (development accelerating potential) V1=−1350 V and a second peak voltage (development drawing back potential) V2=+150 V. The ratio T1/T2 of the duration T1 of the first peak voltage and that T2 of the second peak voltage is called duty ratio (abbreviated as "duty"), and a rectangular AC bias with a duty ratio not equal to 50% is called "duty bias". The duty bias mentioned above has a duty ratio of 36.7% with the DC component Vdc=−400 V. The light potential VL on the photosensitive drum 1 is −150 V while the dark potential VD is −600 V.

In the developing bias of the present invention shown in FIG. 7A, a longer solid-lined arrow indicates flying of the negatively charged toner from the developing sleeve 6 to the photosensitive drum 1. The toner flies in proportion to the potential difference |V1−VL|=1200 V between the development accelerating potential V1 and the light potential VL, thereby accelerating the development. A shorter solid-lined arrow indicates returning (drawing back) of the negatively charged toner from the photosensitive drum 1 to the developing sleeve 6, wherein the toner returns in proportion to the difference |V2−VL|=300 V between the development retarding (drawing back) potential V2 and the light potential VL.

Figure 7B:
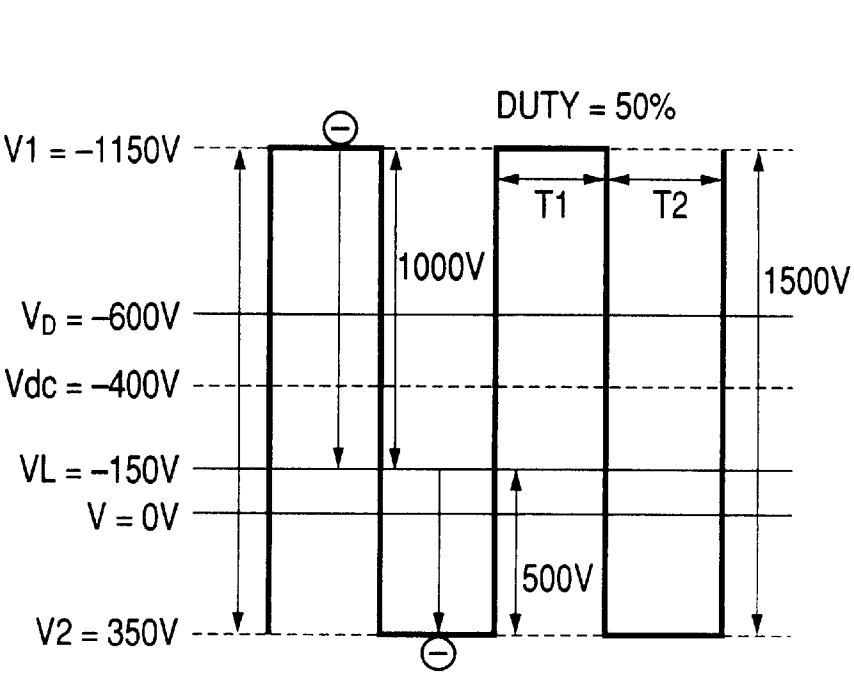

FIG. 7B shows the conventional developing bias, which is an ordinary rectangular AC bias with a duty ratio of 50%, having a peak-to-peak voltage Vpp=1500 V, a frequency f=1800 Hz with a development accelerating potential (first peak voltage) V1=−1150 V and a development retarding potential (second peak voltage) V2=+350 V. The DC component Vdc is −400V as in the case shown in FIG. 7A.

In the conventional developing bias shown in FIG. 7B, the negatively charged toner flies in proportion to the potential difference |V1−VL|=1000 V between the development accelerating potential V1 and the light potential VL, and returns from the photosensitive drum 1 toward the developing sleeve 6 in proportion to the difference |V2−VL|=500 V between the development retarding (drawing back) potential V2 and the light potential VL.

In general, the toner particle of a charge q on the developing sleeve 6 receives, under the development accelerating electric field E between the photosensitive drum 1 and the developing sleeve 6, the van der Waals force and the magnetic force in the 0-th order (constant) of the charge q and the reflection force in the second order of the charge q in a direction to retain the toner on the developing sleeve, and, in a direction to fly the toner from the developing sleeve, the developing bias in the first order of the charge q. Therefore, in order that the toner can fly from the developing sleeve, there is required a condition:

$$q \times E \geqq (M + k \times q^2)$$

wherein M indicates the van der Waals force and the magnetic force (constant) and k is the coefficient of the reflection force.

The condition is solved with respect to q to obtain solutions q1, q2, and the toner can fly from the developing sleeve toward the photosensitive drum if the toner charge q is within a range:

$$q1 \leqq q \leqq q2.$$

In general, there will result a low image density because of the insufficient charge in case q<q1, and there will result a low image density because of excessive charging in case q2<q.

The above-mentioned development accelerating electric field E can be represented as:

$$E = |V1 - VL|/H$$

wherein H indicates the SD gap between the developing sleeve 6 and the photosensitive drum 1, V1 is the development accelerating potential and VL is the light potential.

The toner starts flying from the developing sleeve toward the photosensitive drum, in proportion to the development accelerating electric field E, namely in proportion to the potential difference |V1−VL|. If the potential difference |V1−VL| is low, the range of the charge amount allowing toner flight from the developing sleeve to the photosensitive drum becomes narrower.

Table 2 shows the charge range allowing toner flight, in the developing bias (duty bais) of the present embodiment and in the conventional developing bias (rectangular AC bias).

TABLE 2

| Developing bias (Vdc = −400 V) | Toner flying potential \|V1 − VL\| | Toner flying charge range Ave. particle size 8 μm | Toner flying charge range Ave. particle size 6 μm |
|---|---|---|---|
| Duty bias | 1200 V | 3 to 17 μC/g | 7 to 20 μC/g |
| Conventional bias | 1000 V | 5 to 15 μC/g | 9 to 18 μC/g |

As shown in Table 2, the duty bias of the present invention has a higher potential and a larger charge amount range of causing the toner flight in comparison with the conventional bias.

It is already known that the van der Waals force and the reflection force, acting on the toner, increase with the decrease in the particle size of the toner sticking to the developing sleeve, since the distance from the center of mass of the toner particle to the developing sleeve becomes smaller. Also in the data shown in Table 2, the toner charge amount for starting the toner flight increases when the particle size of the toner is reduced from 8 μm to 6 μm, because of the increase in the van der Waals force and in the reflaction force.

Figure 9:
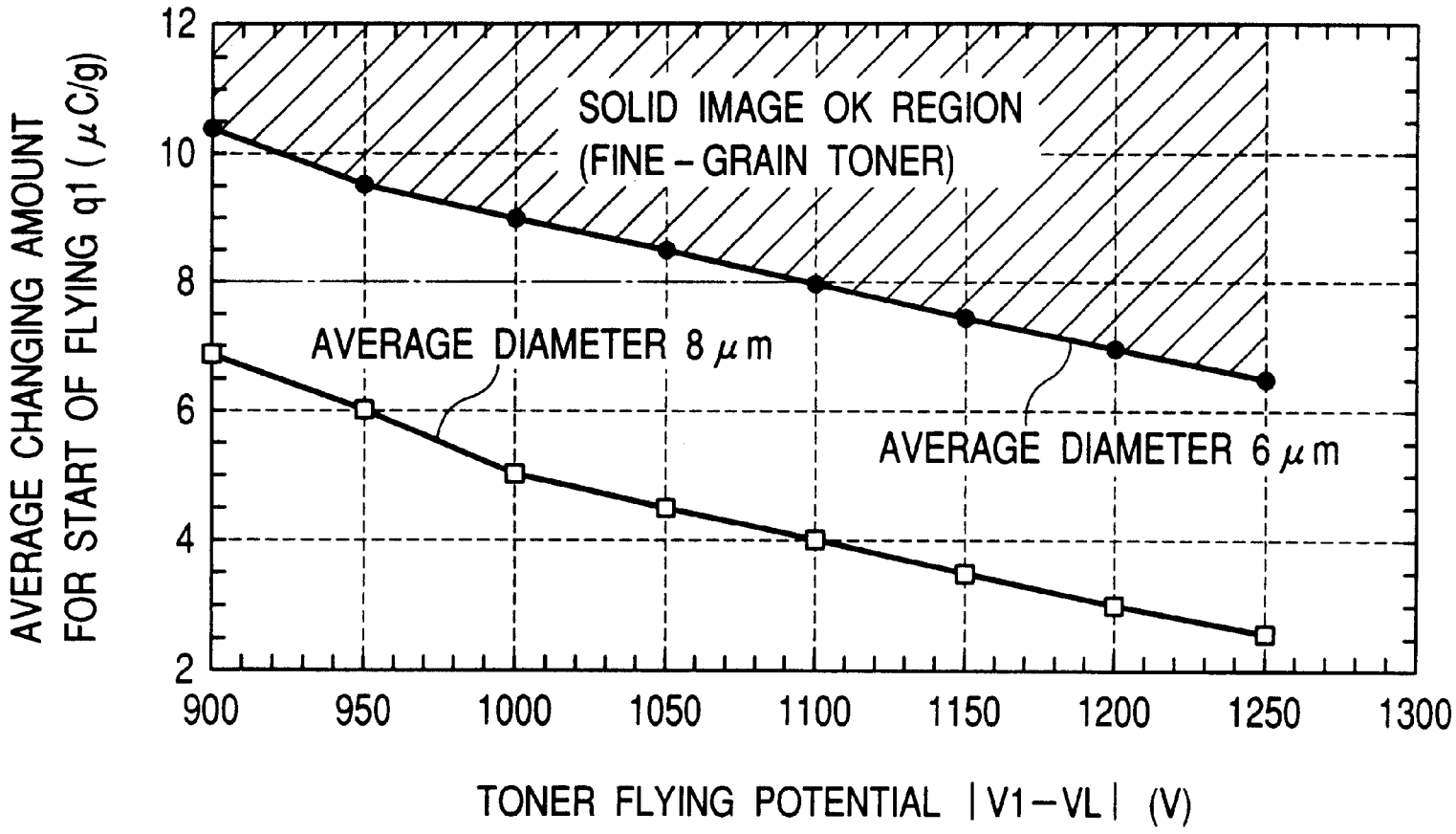
FIG. 9 is a chart representing the change in the flying start charge amount q1 of the toner as a function of the toner flying potential $|V1-VL|$, and showing the difference between the average particle sizes of 8 μm and 6 μm of the toner.

The charge q1, obtained by solving the aforementioned condition, is the charge for starting the toner flight, beyond which the toner starts to fly. FIG. 9 is a chart showing the difference, between 8 and 6 μm in the average particle size of the toner, in the toner flight starting charge q1 as a function of the toner flying potential |V1−VL|. In FIG. 9, the area positioned above the curve corresponding to each particle size indicates the range of the charge amount allowing the toner of such particle size to fly.

As shown in FIG. 9, the toner can fly toward the photosensitive drum with a relatively low charge amount, if the average particle size of the toner is 8 μm. On the other hand, the toner with the average particle size of 6 μm requires a high charge amount for flying toward the photosensitive drum, and the toner with a low charge amount cannot fly unless the toner flying potential |V1−VL| is made larger.

The charge amount of the fine particle toner is elevated by the addition of the positive external additive, but may be reduced as low as 8 μC/g in consideration of the extreme case where the contact pressure of the elastic blade 10 is drastically lowered for example by the deterioration thereof in time. In FIG. 9, the flying potential |V1−VL| of the fine particle toner corresponding to 8 μC/g is 1100 V, so that the development accelerating electric field E for the SD gap of 300 μm is given by:

$$E = |V1 - VL|/H = 1100\ \text{V}/300\ \mu\text{m} = 3.7 \times 10^{-6}\ \text{V/m}.$$

Consequently, in order that the toner can satisfactorily fly, the development accelerating electric field E is required to satisfy a condition:

$$E = |V1 - VL|/H \geqq 3.7 \times 10^{-6}\ \text{V/m} \quad (1).$$

Figure 8A:
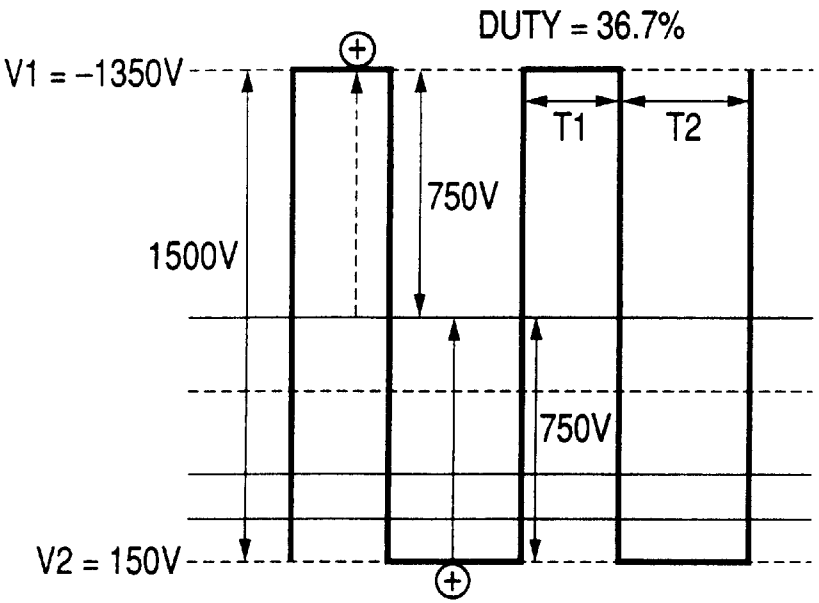
FIGS. 8A and 8B are potential charts similar to FIGS. 7A and 7B, with arrows indicating the direction of movement of the positive external additive instead of the negative toner.
Figure 8B:
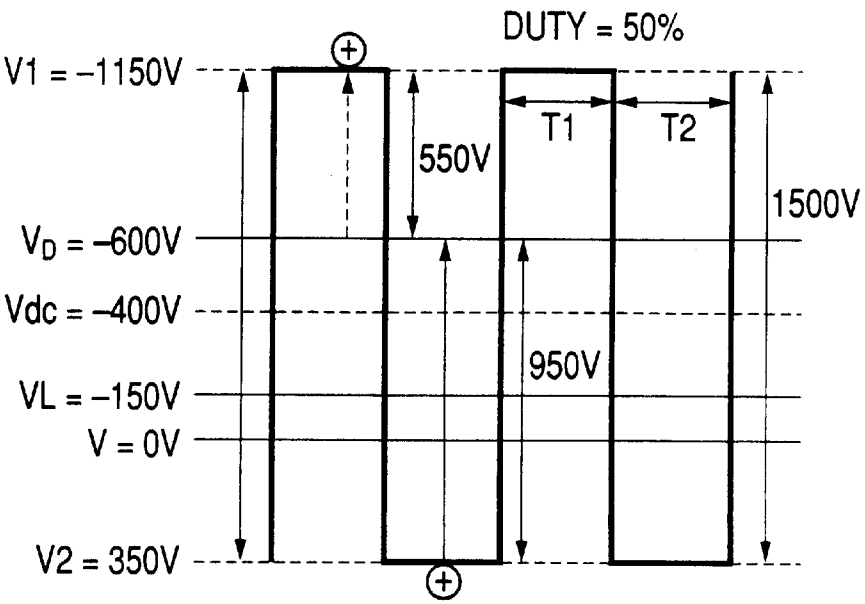

FIGS. 8A and 8B are potential charts showing the developing bias of the present invention shown in FIG. 7 and the conventional developing bias, with the directions of flying and returning of the positive external additive. In these charts, solid-lined arrows indicate that the positive external additive can easily move from the developing sleeve 6 to the photosensitive drum 1 while broken-lined arrows indicate that the positive external additive cannot easily move. Table 3 shows the potentials acting on the positive external additive.

TABLE 3

| Developing bias (Vdc = −400 V) | External additive flying potential \|V2 − VL\| | External additive flying amount |
|---|---|---|
| Duty bias | 750 V | little |
| Conventional bias | 950 V | large |

The positive external additive, being positively charged, is attracted from the developing sleeve 6 to the negative dark potential area (white image (background) area) VD of the photosensitive drum 1 and tends to fly thereto. The positive charge amount of the positive external additive is smaller than the charge amount of the negative toner, and a sufficient charge amount |V2−VD| is required for flying from the developing sleeve to the photosensitive drum, overcoming the mirror reflection for and the van der Waals force.

Figure 10:
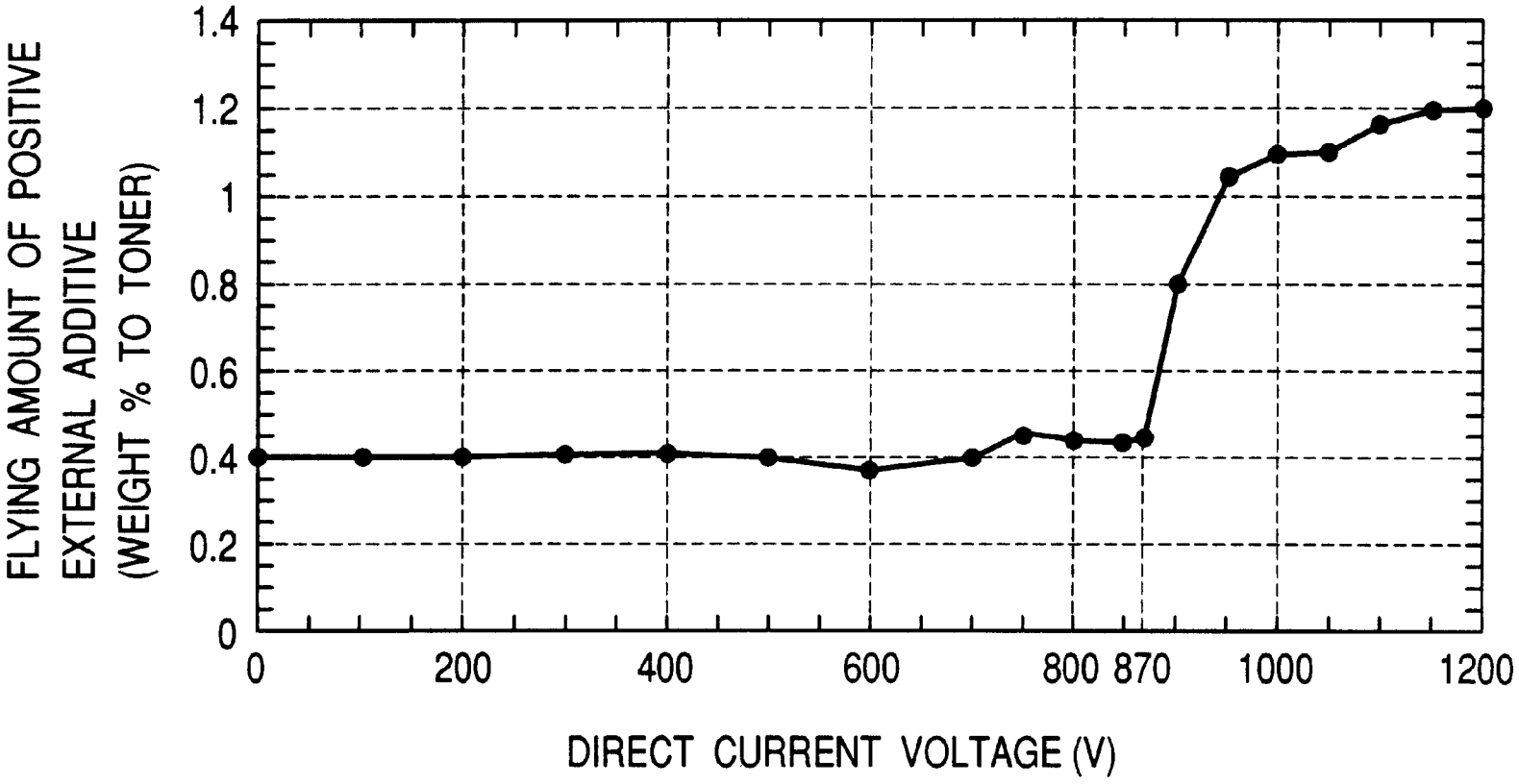
FIG. 10 is a chart showing the flying amount of the positive external additive to the photosensitive drum, represented by the weight ratio to the flying toner amount, as a function of the DC voltage applied to the developing sleeve.

In the following there will be explained the function of the positive external additive under the electric field. FIG. 10 shows the flying amount of the positive external additive to the photosensitive drum, as a function of the DC voltage applied to the developing sleeve. The flying amount of the positive external additive is represented by the weight ratio to the amount of the flying toner.

Figure 11:
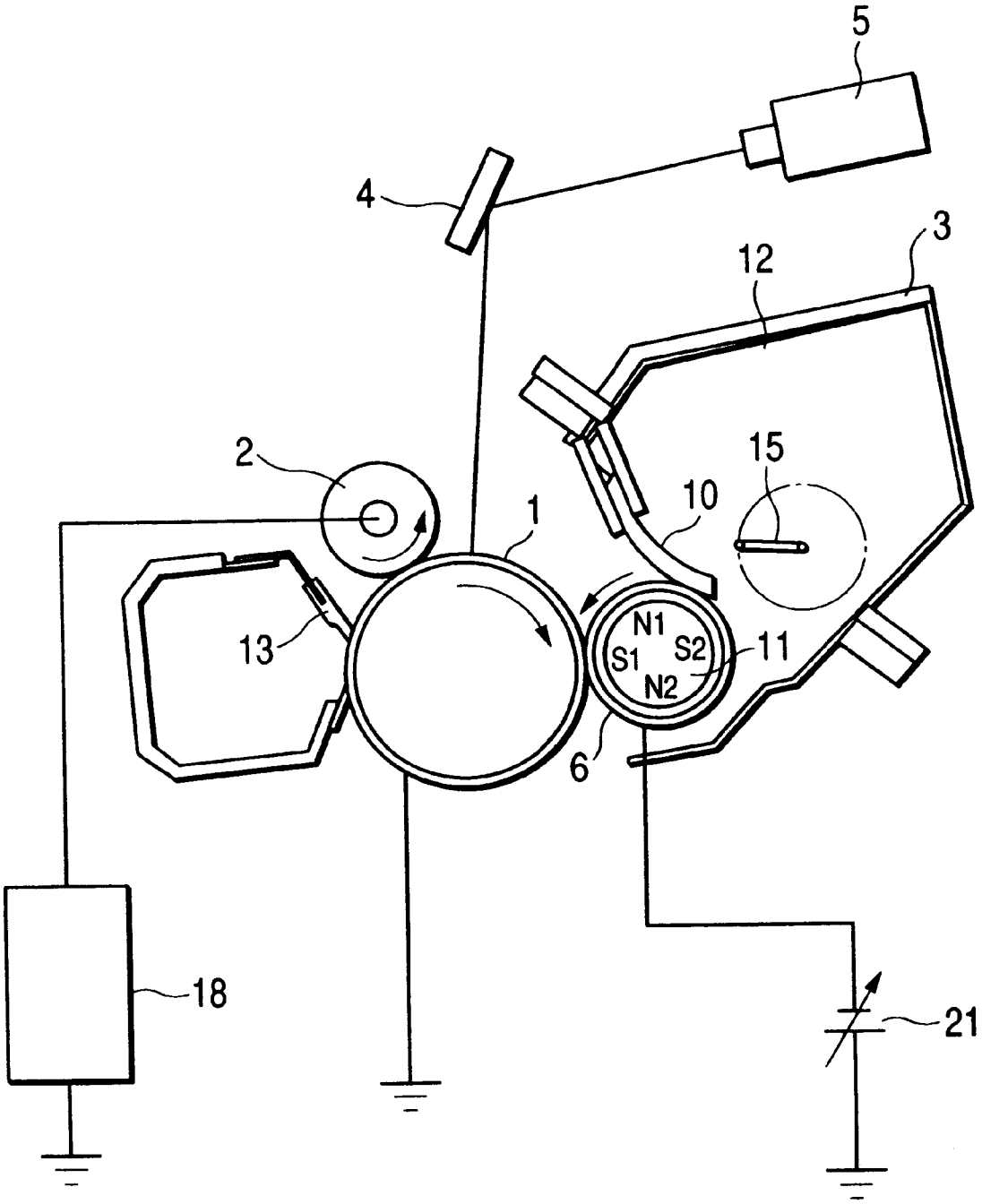
FIG. 11 is a schematic view showing the method for measuring the flying amount of the positive external additive employed in the present invention.

The flying amount of the positive external additive is measured by placing the toner in the developing container 12 of the developing apparatus 3 as shown in FIG. 11, applying a DC voltage in plural levels from the high voltage source 20 to the developing sleeve 6 with the SD gap of 300 $\mu$m between the developing sleeve 6 and the photosensitive drum 1, recovering the toner flown to the photosensitive drum 1 for each DC voltage level and measuring the weight ratio of the positive external additive in the recovered toner. The duration of application of the DC voltage is selected as 1 second, which is considered sufficient for flying at each DC voltage level.

As shown in FIG. 10, when the DC voltage applied to the developing sleeve is low, the positive external additive flies in a form associated with the toner (namely sticking to the toner particle or retained between the toner particles), and the flying amount is substantially constant at 0.4% of the flying toner amount. However, when the DC voltage is elevated, the flying amount of the positive external additive rapidly increases from 870 V, indicating that the positive external additive starts to fly, separately from the toner particles, by the potential difference.

These results indicate that the positive external additive requires a threshold potential of about 870 V for flying because of the low positive charge amount and cannot fly alone if the potential difference does not exceed such threshold value. Stated differently, if the potential difference |V2−VD| between the second peak voltage V3 of the AC component of the developing bias and the dark potential VD on the photosensitive drum 1 does not exceed 870 V, the positive external additive cannot overcome the reflaction force and the van der Waals force with the developing sleeve 6 and cannot therefore fly singly.

In practice, the positive external additive moves according to the electric field between the developing sleeve 6 and the photosensitive drum 1, and the electric field E' not causing flight for the SD gap H=300 $\mu$m can be calculated as:

$$E'=|V2-\mathrm{VD}|/H=870\ \mathrm{V}/300\ \mu\mathrm{m}=2.9\times10^{-6}\ \mathrm{V/m}.$$

Consequently, in order that the positive external additive does not fly, the electric field E' should satisfy the following condition.

$$E'=|V2-\mathrm{VD}|/H\leqq2.9\times10^{-6}\ \mathrm{V/m} \qquad (2).$$

In the case of the conventional bias, as shown in Table 3, the potential difference |V2−VD| is 950 V which is 870 V or more allowing single flight of the positive external additive, and the positive external additive may be consumed in the initial phase of image formations by the flight thereof. On the other hand, in the present embodiment, the second peak voltage V2 for causing the flight is lowered to 150 V to reduce |V2−VD| to 750 V, whereby the positive external additive does not fly alone and is prevented from consumption until the latter phase of image formations.

Figure 12:
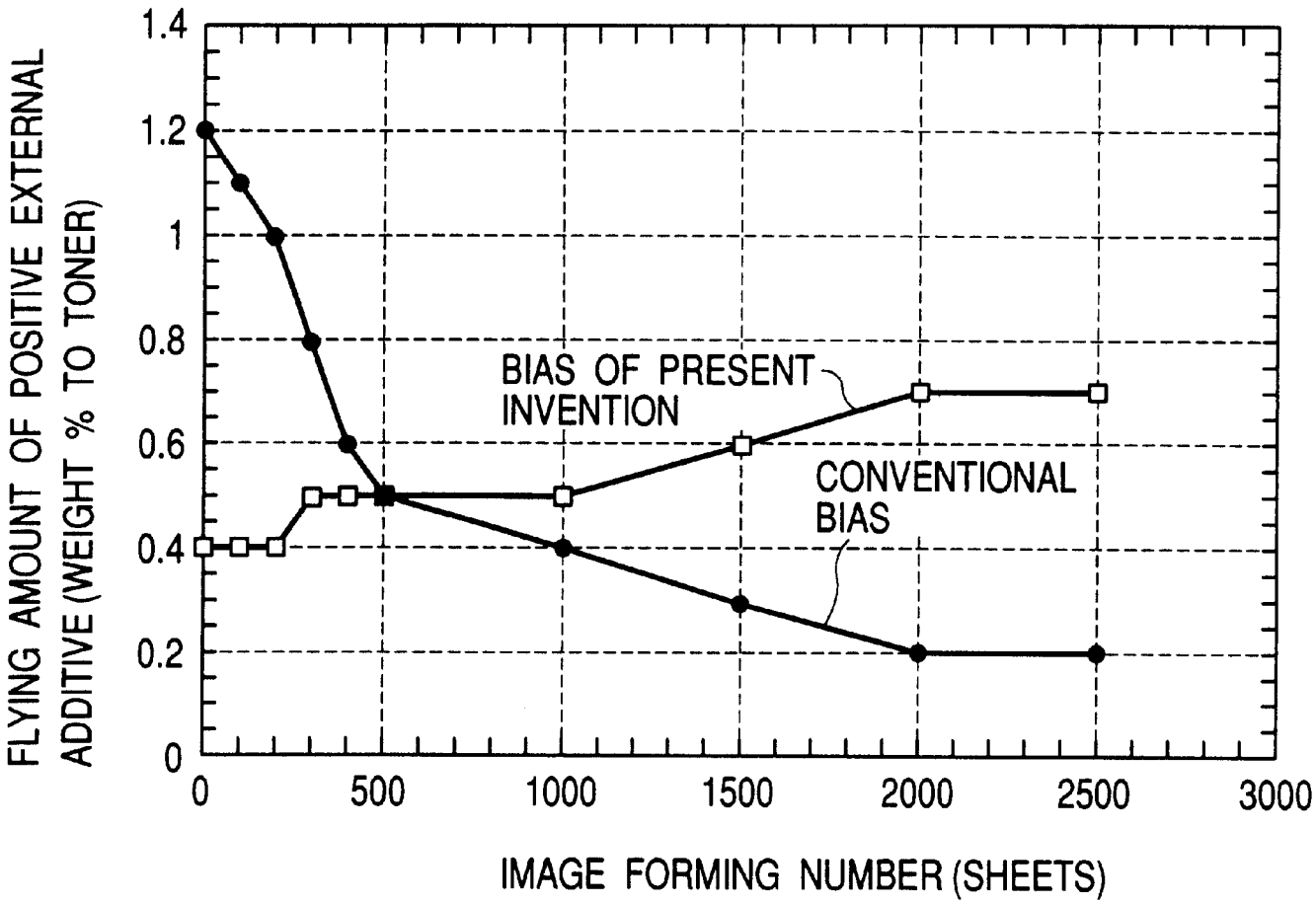
FIG. 12 is a chart showing the change in the flying amount of the positive external additive as a function of the number of image formations, for the developing bias of the present invention and the conventional developing bias.

FIG. 12 shows the change in the flying amount of the positive external additive as a function of the number of image formations, with the developing bias of the present invention and the conventional developing bias. The duty bias of the present invention causes little flight of the positive external additive, thereby suppressing the consumption thereof and maintaining the positive external additive within the developing container 12 until the latter phase of image formations.

Figure 13:
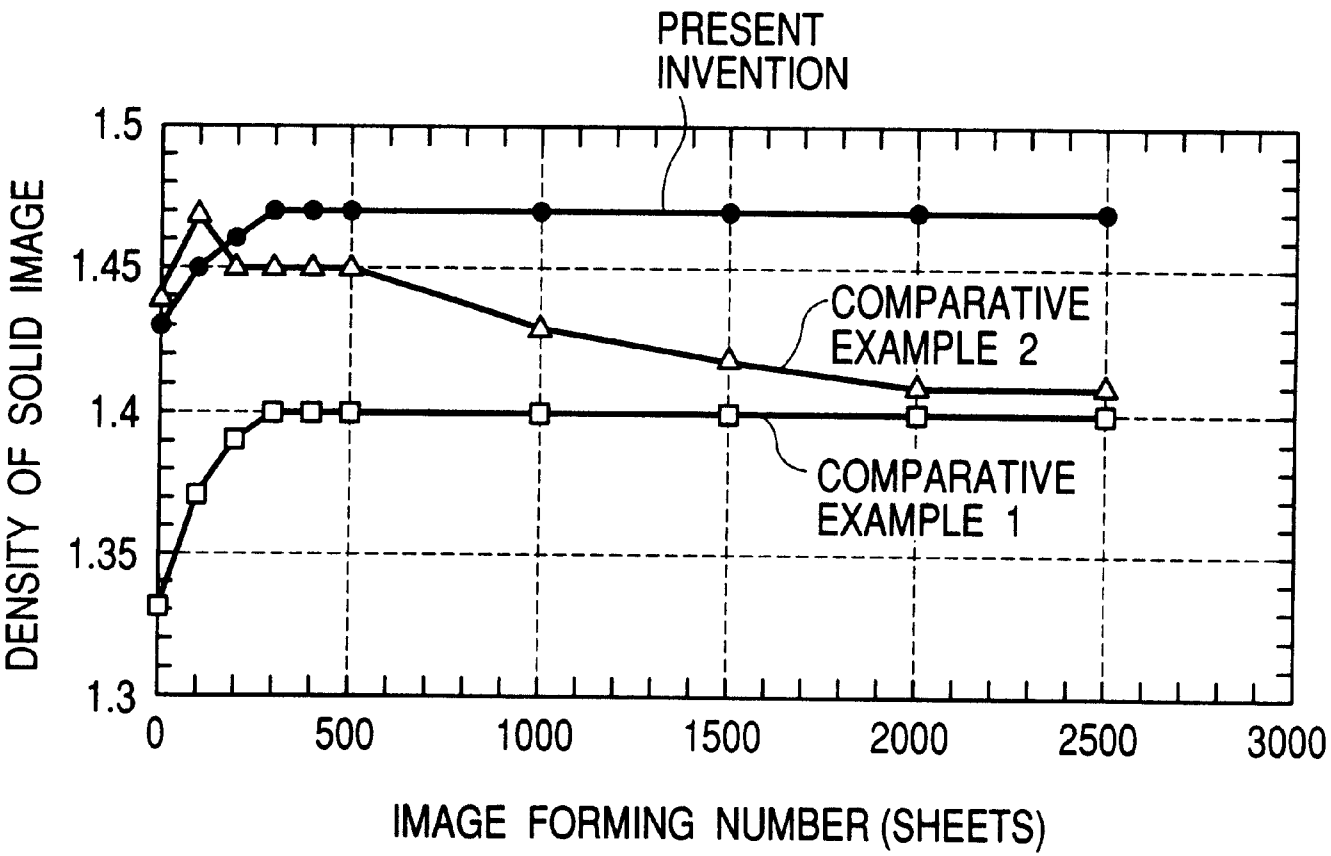
FIG. 13 is a chart showing the change in the solid black density as a function of the number of image formations in the present invention and in the comparative example.
Figure 14:
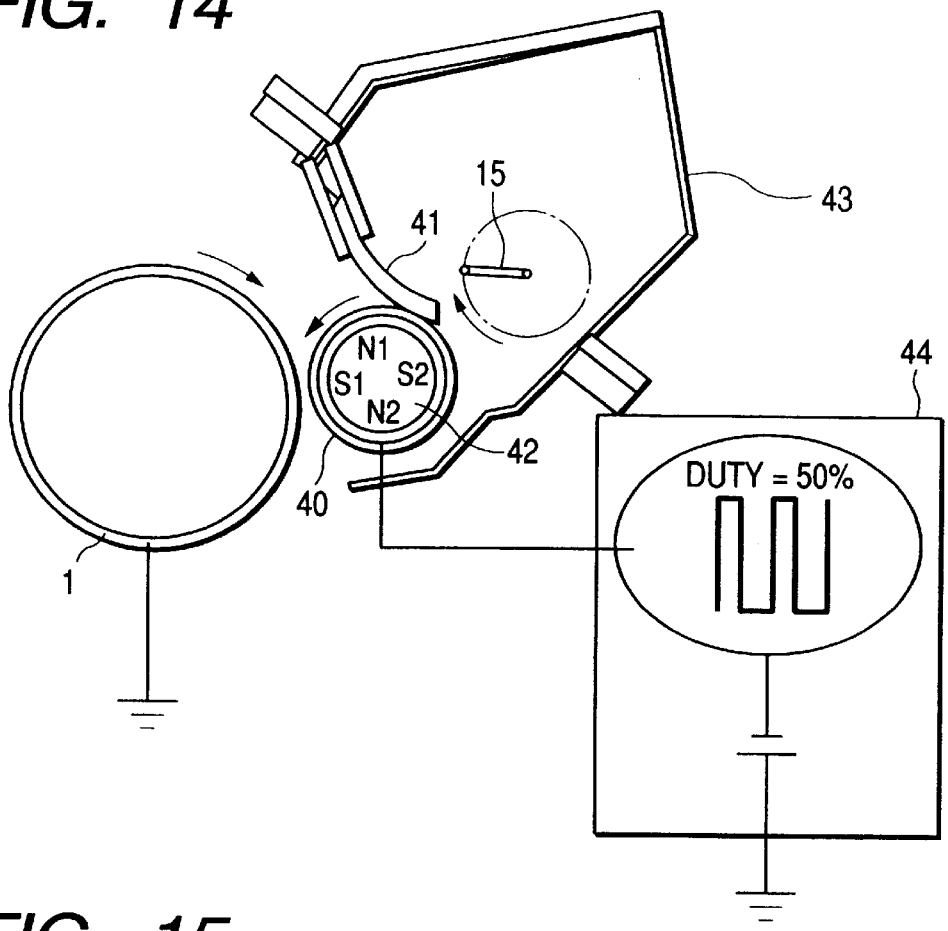
FIG. 14 is a schematic view showing an example of the developing apparatus.
Figure 15:
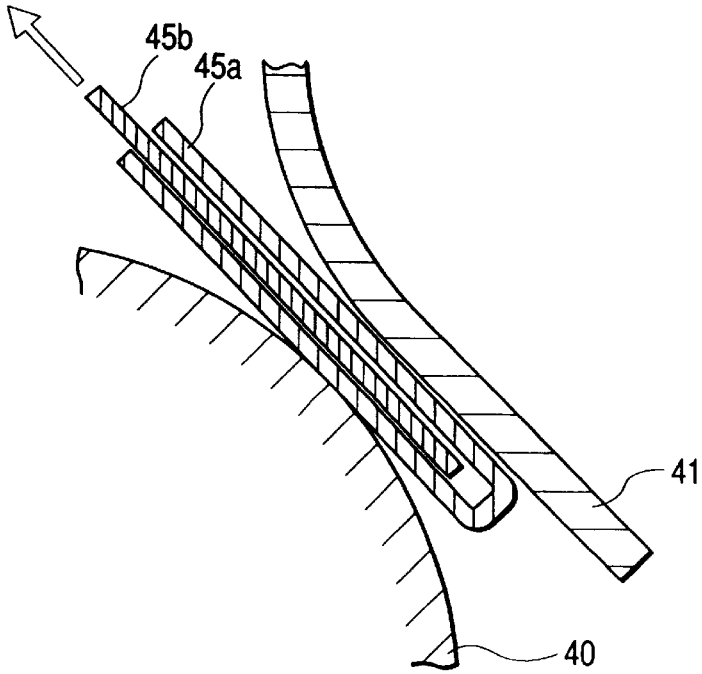
FIG. 15 is a schematic view showing the method of measuring the contact pressure of the elastic blade employed in the present invention.
Figure 16:
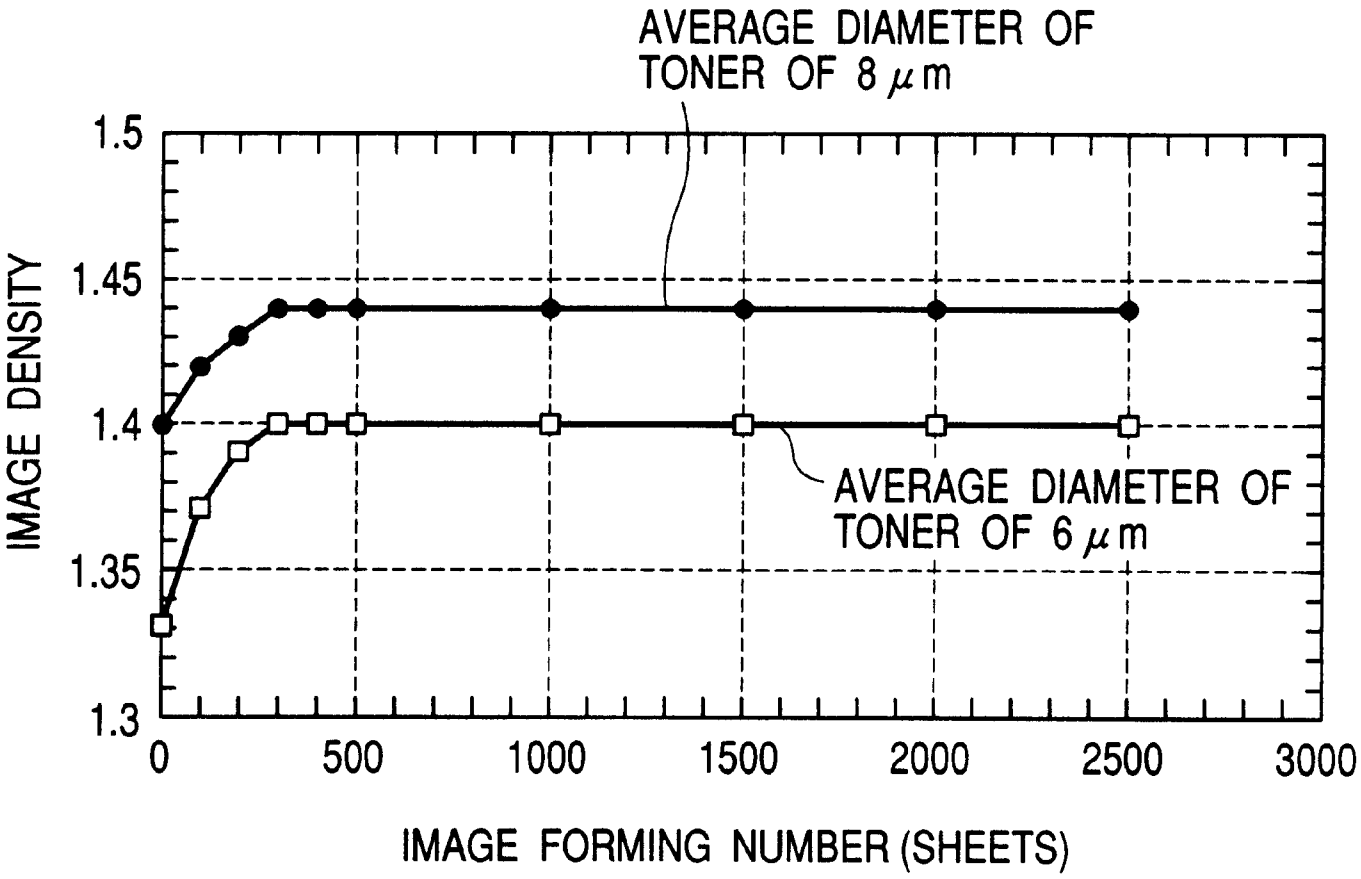
FIG. 16 is a chart representing the change in the image density as a function of the number of image formations and showing the difference between the average particle sizes of 6 $\mu$m and 8 $\mu$m of the toner.
Figure 17:
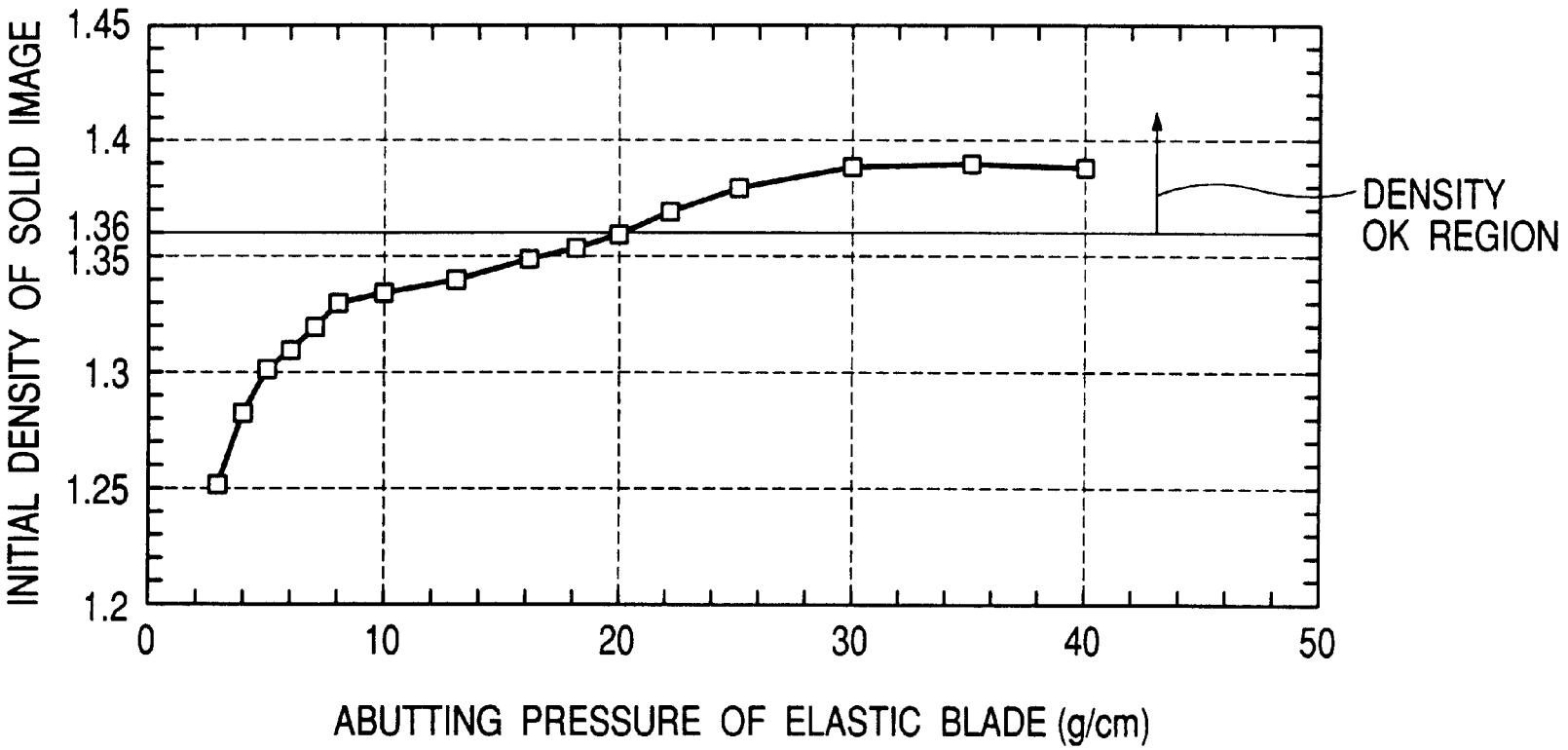
FIG. 17 is a chart representing the change in the initial density of the solid black image as a function of the contact pressure of the elastic blade in case the negative fine particle toner is employed in the developing apparatus shown in FIG. 14.

FIG. 13 shows the change in the solid black density as a function of the number of image formations, in the present invention and in the comparative examples. The comparative example 1 shows a combination of the fine particle toner with the conventional developing bias, while the comparative example 2 shows a combination of the fine particle toner with the addition of the positive external additive and the conventional developing bias.

As shown in FIG. 13, the comparative example 1 provides a low density until the end of 2500 image formations. The comparative example 2 provides a satisfactory initial density because of the addition of the positive external additive, but the conventional developing bias causes consumption of the positive external additive in the initial phase, whereby the image density is lowered in the latter phase of image formations because the charge can no longer be given to the fine particle toner by the positive external additive. According to the present invention, the density remains satisfactory without lowering not only in the 2500 image formations shown in FIG. 13 but also in the entire service life of the process cartridge.

As explained in the foregoing, the present invention allows to satisfactorily charge the fine particle toner even with a low contact pressure of the elastic blade, since the additive of an opposite polarity is added to the fine particle toner to achieve additional charging thereof by friction with such additive.

Also, the developing bias consists of an AC duty bias of rectangular wave form, with an elevated first peak voltage V1 for accelerating the development, whereby the developing ability of the fine particle toner is not deteriorated. Also, the second peak voltage V2, inducing the flight of the positive external additive, is lowered to prevent the flight of the positive external additive to the dark potential portion (while image area), thereby preventing the consumption of such positive external additive. It is therefore rendered possible to obtain a sufficient image density from the beginning to the end of multiple image formations.

The foregoing embodiment employs strontium titanate as the additive of a polarity opposite to that of the fine particle toner, but such example is not restrictive as long as similar functions can be attained. Also the developing bias is not limited to that in the foregoing example, as long as the conditions (1) and (2) are satisfied.

The present invention, as explained in the foregoing, allows to prevent low image density with the fine particle toner of the average particle size of 6.5 $\mu$m or less, by adding thereto an external additive, such as strontium titanate, having a charging polarity opposite to that of the toner, in order to additionally attain charging of the toner particles by friction with the particles of the external additive. It is thus rendered possible to satisfactorily charge the fine particle toner even with a low contact pressure of the elastic blade on the developing sleeve, thereby preventing low image density in the development with such fine particle toner. The fine particle toner can therefore be applied to a compact developing apparatus in which the developing sleeve is of a small diameter and a small thickness and is therefore easily bent, and a compact process cartridge can therefore be realized. Furthermore, the developing bias consists of an AC duty bias of rectangular wave form with a high first peak voltage and a low second peak voltage to sufficiently fly the fine particle toner to the photosensitive drum and to prevent flight of the external additive thereto, thus suppressing the consumption thereof and maintaining a sufficient image density from the beginning to the end of multiple image formations.

What is claimed is:

1. A developing apparatus comprising:

a developer bearing member for bearing and carrying developer to a developing area;

developer borne on said developer bearing member, wherein said developer has a weight average particle size not exceeding 6.5 $\mu$m and contains an external additive of a charging polarity opposite to that of said developer; and voltage application means for applying a voltage to said developer bearing member, wherein said voltage including at least a first voltage V1 for acting on said developer in a direction from said developer bearing member toward an image bearing member and a second voltage V2 for acting on said developer in a direction from said image bearing member toward said developer bearing member, and a charged potential VL of said image bearing member, a latent image potential VD a distance H between said developer bearing member and said image bearing member, and wherein said voltages V1 and V2 satisfy a following relationships:

$$|V1-VL|/H \leqq 3.7\times10^{-6} \text{ V/m; and}$$

$$|V2-VD|/H \leqq 2.9\times10^{-6} \text{ V/m.}$$

2. A developing apparatus according to claim 1, further comprising a developer regulating member for regulating the developer borne on said developer bearing member.

3. A developing apparatus according to claim 2, wherein said developing regulating member is in contact with said developer bearing member.

4. A developing apparatus according to claim 3, wherein said contact is with a pressure not exceeding 20 gf/cm.

5. A developing apparatus according to claim 1, wherein said developing apparatus is detachably attachable to a main body of an image forming apparatus.

6. A developing apparatus according to claim 1, wherein said developing apparatus is a process cartridge further including an electrophotographic photosensitive member as an image bearing member and is detachably attachable to a main body of an electrophotographic image forming apparatus.

7. An image forming apparatus comprising:

an image bearing member for bearing a latent image;

a developer bearing member for bearing and carrying a developer to a developer area;

developer borne on said developer bearing member, wherein said developer has a weight average particle size not exceeding 6.5 $\mu$m and contains an external additive of a charging polarity opposite to that of said developer; and voltage application means for applying a voltage to said developer bearing member, wherein said voltage including at least a first voltage V1 for acting on said developer in a direction from said developer bearing member toward an image bearing member and a second voltage V2 for acting on said developer in a direction from said image bearing member toward said developer bearing member, and a charged potential VL of said image bearing member, a latent image potential VD, a distance H between said developer baring member and said image bearing member, and wherein said voltages V1 and V2 satisfy a following relationships:

$$|V1-VL|/H \leqq 3.7\times10^{-6} \text{ V/m; and}$$

$$|V2-VD|/H \leqq 2.9\times10^{-6} \text{ V/m.}$$

* * * * *

UNITED STATES PATENT AND TRADEMARK OFFICE

CERTIFICATE OF CORRECTION

PATENT NO. : 6,272,306 B1
DATED : August 7, 2001
INVENTOR(S) : Masanobu Saito et al.

It is certified that error appears in the above-identified patent and that said Letters Patent is hereby corrected as shown below:

Title page,
Item [57] ABSTRACT,

"$|v1-vl|/H \leq 3.7\times10^{-6}$ V/M; and" should read –$|V1 - VL|/H \geq 3.7\times10^{-6}$ V/m; and–.

Column 2,
Line 38, "charge." should read -- change. --.

Column 5,
Line 48, "Also" should read -- Also, --.

Column 8,
Table 1, "g/cm" (all occurrences) should read -- gf/cm --
Line 36, "g/cm" should read -- gf/cm --; and
Line 63, "Consequently" should read -- Consequently, --.

Column 12,
Line 65, "following" should read -- following, --.

Column 13,
Line 36, "singly." should read -- above. --.

Column 14,
Line 43, "Also" should read -- Also, --.

Column 15,
Line 22, "$|V1-Vl|/H \leq 3.7\times10^{-6}$ V/m; and" should read –$|V1 - VL|/H \geq 3.7\times10^{-6}$ V/m; and.

UNITED STATES PATENT AND TRADEMARK OFFICE

CERTIFICATE OF CORRECTION

PATENT NO. : 6,272,306 B1
DATED : August 7, 2001
INVENTOR(S) : Masanobu Saito et al.

It is certified that error appears in the above-identified patent and that said Letters Patent is hereby corrected as shown below:

Column 16,
Line 27, "baring" should read -- bearing --.

Signed and Sealed this

Twenty-sixth Day of March, 2002

*Attest:*

*Attesting Officer*

JAMES E. ROGAN
*Director of the United States Patent and Trademark Office*